United States Patent [19]

Bain

[11] 4,089,147

[45] May 16, 1978

[54] MODULE HAVING COLLAPSIBLE PROPERTIES

[76] Inventor: Sujash Kumar Bain, D-3, Maharani Bagh, New Delhi-14, India

[21] Appl. No.: 721,369

[22] Filed: Sep. 8, 1976

[30] Foreign Application Priority Data

Aug. 2, 1976 United Kingdom ..... 32133/76

[51] Int. Cl.[2] ..... E04G 25/02; E04H 12/18

[52] U.S. Cl. ..... 52/632; 52/108; 52/646; 248/421

[58] Field of Search ..... 52/108, 121, 632, 646; 182/152; 248/158, 166, 282, 284, 421

[56] References Cited

U.S. PATENT DOCUMENTS

| | | | |
|---|---|---|---|
| 483,777 | 10/1892 | Bredsvold | 248/421 |
| 3,416,267 | 12/1968 | Maniu | 52/121 |
| 3,435,570 | 4/1968 | Berry | 52/111 X |
| 3,606,719 | 9/1971 | Berry | 52/632 |
| 3,794,283 | 2/1974 | Furno | 248/421 X |
| 3,904,853 | 9/1975 | Shoup et al. | 248/421 X |

FOREIGN PATENT DOCUMENTS

| | | | |
|---|---|---|---|
| 914,298 | 6/1946 | France | 52/646 |
| 1,091,959 | 11/1960 | Germany | 52/117 |

*Primary Examiner*—Alfred C. Perham
*Attorney, Agent, or Firm*—Hammond & Littell

[57] ABSTRACT

A collapsible module comprising an upper and lower member disposed in an opposite relationship to each other, each of said members comprising a base plate or frame with a plurality of side plates or frames hingedly connected at their proximal end thereto, the distal end of the side plates or frames of the lower member being hingedly connected to the distal end of the side plates of the upper member.

12 Claims, 3 Drawing Figures

MODULE HAVING COLLAPSIBLE PROPERTIES

OBJECTS OF THE INVENTION

An object of this invention is to propose a novel construction of a collapsible module.

An associated object of this invention is to propose a module which can be easily transported.

Still another object of this invention is to propose a module which through being collapsible, possesses the requisite strength and stability properties.

A further object of this invention is to propose a collapsible column incorporating the modules of this invention and which said column can be erected in a comparatively short period of time.

A still further object of this invention is to propose a module having several applications.

Further objects and advantages of this invention will be apparent from the ensuing description.

DESCRIPTION OF THE INVENTION

According to this invention there is provided a collapsible module comprising an upper and lower member provided in an opposite relationship to each other, each of said members comprising a base plate or frame, side frames or plates hingedly connected at their proximal end to said base plate or frame, the distal end of said side frames or plates being hingedly connected to the distal end of the side frames or plates of the other member, said members having each a plurality of said side plates, and such that in an erect and self locking position the side plates are angularly disposed with respect to the vertical axis.

Further according to this invention a plurality of said collapsible modules are provided in order to form, for example, a collapsible column and wherein adjacent modules are hingedly connected to each other. Alternatively, the base plate or frame of the lower members of one module could also form the base plate or frame of the upper member of the adjacent module.

In order to illustrate an exemplary application of the module of this invention, reference is made herein to a column. The collapsible column consists of a plurality of modules and wherein adjacent modules are hingedly connected to each other. Alternatively, the base plate of the lower member of one module may form also the base plate of the upper member of the adjacent module and, wherein, the adjacent modules are provided in a hinged relationship to each other. Thus, the number of modules employed in a column would depend on the required height of the column. The modules are identical or substantially identical to each other in that each module comprises said upper and lower members. However, and as by way of example, certain of the modules may also have additional constructional features, such as bracing members.

Each module comprises an upper and lower member and which are disposed in an opposite relationship to the each other.

Each of said members comprise a base plate or frame having side plates or frames hingedly connected at their proximal ends thereto. Thus, if the base plate or frame has a construction to constitute a plurality of arms, a single side plate or frame is provided for each arm and wherein each of said side plate or frame is hingedly connected at its proximal end to its respective arm. The distal end of each side plate or frame is hingedly connected to the distal end of the respective side plate or frame of the other member, and such that in a collapsed position, the side plates or frames extend outwardly of their respective base member.

In accordance with one aspect of this invention, each member has a plurality of side plates and such that when the column is in an erect position, and in order to ensure a self locking action, the two sides of one side plate of one member is in side contact with the adjoining side plates of the same member. However, a collapse of the module is prevented once the side plates are disposed inwardly and at an angle with respect to the vertical axis. Thus, in such an instance, even through a self locking action is not effected, a collapse of the module is still prevented.

In accordance with one specific embodiment of this invention, the two opposite sides of the side plate are tapered inwardly and such as to provide a big end and a small end of each member and, wherein, the small end of one member is hingedly connected to the small end of the other member. Thus, the length of the distal side of each side plate is shorter than that of the proximal side.

The provision of such tapering sides is attended with several advantages. One such advantage is that when a column is erected from a collapsed to an erect position, each of the modules is self locking.

It will be apparent that a collapse of the module, when in an erect position, can only occur if the side plates are displaced either outwardly or inwardly along the horizontal plane. A displacement in the outward direction can occur due to the weight of the superimposed modules, or due to the weight of the compression load, and which said weight acts in the downward direction. However, due to the tapering sides, and once the module is erected to a position that the side plates are inclined inwardly though the side plates may not be in side contact, a compression load in the downward direction would urge the side plates more in the inward direction rather than in the outward direction and, whereby, the possibility of any displacement of the side plates in the outward direction is completely prevented. Thus, once a module is erected to a position such that the side plates are inclined inwardly, and due to the weight of the modules acting on the next lower adjacent module, the column has the inherent property of being stable. It will be apparent that the upper member has a load acting on the lower member along the vertical axis and in the downward direction and, thus, due to the weight of the members itself, the module has the stable properties.

However, reference is made hereinabove only to the stable properties of the module. In accordance with this invention, the module also has inherent self locking properties. Such a self locking property is achieved once the opposite sides of a side plate establishes a side contact with the sides of the adjoining side plates of the same member. It will be apparent that greater the load supported by the column, the better the locking action between the two members. Simultaneously, an unlimited displacement of the side plates in the inward direction is prevented once the side plates are in side contact with their respective adjacent side plates. Accordingly, and when in an erect position, the side plates are disposed angularly and inwardly along the vertical axis until the sides of the side plates establish a side contact with the sides of the adjacent side plates of the same member in order to provide firstly the stability properties, and, secondly, the self locking properties.

The upper and lower members are identical or substantially identical to each other in that each member comprises said base and side plates or frames.

DESCRIPTION WITH REFERENCE TO DRAWINGS

Figure 1:
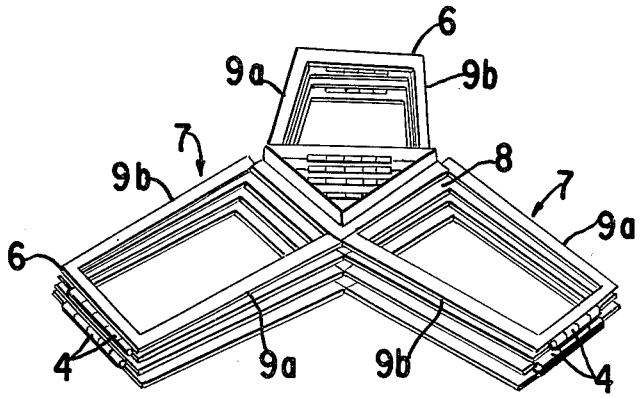
FIG. 1 shows a perspective of a column incorporating the modules of this invention in a collapsed status.
Figure 2:
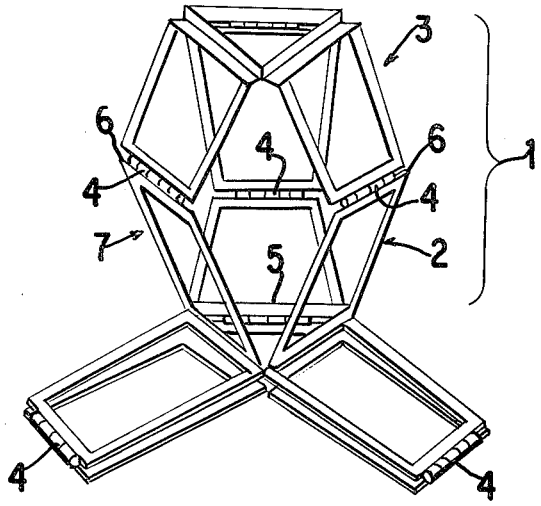
FIG. 2 shows the column in a semi erected position.
Figure 3:
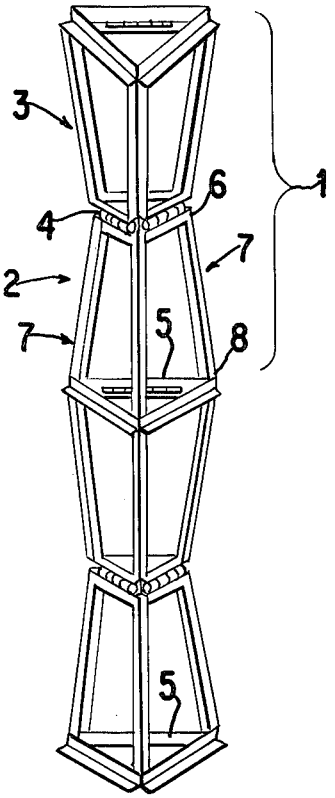
FIG. 3 shows the column in an erected position.

At the outset of the description which follow, it is to be understood that the ensuing description and the accompanying drawings only illustrate one of the particular forms of this invention. However, such a particular form is only an exemplary embodiment, and without intending to imply any limitation on the scope of the invention. Accordingly, the description and drawings are to be understood as an exemplary teaching of the invention and are not to be taken restrictively.

Referring to the drawings, the module 1 consists of a lower member 2 and an upper member 3. As members 2 and 3 are identical to each other, reference is made herein only to the constructional features of member 2. As will be apparent from the drawings, members 2 and 3 are hingedly connected to each other by means of a hinge joint 4. Still further, members 2 and 3 are provided in an opposite relationship to each other.

Member 2 consists of a base frame 5 of a triangular section. Plate 5 is illustrated to be of a triangular section. However, such an illustration is only by way of an exemplary embodiment and without implying any limitation thereto as base frame 5 could be of any configuration. Still further, instead of a frame, base 5 could consist of a plate.

Member 2 further comprises of side frames 7 hingedly connected at the proximal side 8 to base frame 5. Side frames 7 have inwardly tapering sides **9*a* and 9*b* and such that in an erect position the side 9*a* bears a side contact with the side 9*b* of the adjoining sides 9*a* and 9*b*. The distal side 6 of side plate 7 has a length smaller than that of the proximal side 8. Distal side 6 has a hinge joint 4 and such that the distal side of the side plates of upper member 3 is hingedly connected thereto. Reference is made to the side members 7** to consist of a frame. However, such a reference is only by way of an exemplary embodiment in that side members can consist of plates.

Reference is made herein to a column consisting of a plurality of modules and wherein, the base frame 5 of the lower member of one module also forms the base frame of the upper member of the adjacent module. As apparent from FIG. 1, side members 7 are disposed outwardly in relation to their respective base plate 5 when the column or the module is in a collapsed position. Thus, in respect of member 2, the side frames 7 lie outwardly and inclined upwardly to that of base frame 5. However, in respect of member 3, the side frames 7 lie outwardly and inclined downwardly to that of the base plate 5.

For erecting a column, the uppermost module is drawn upwardly until such time that the free sides **9*a* and 9*b* of the side frames are inclined inwardly with respect to the vertical axis. In such an instance, any additional compression load would tend to displace the side frames 7 more inwardly. However, such an inclination in the inward direction is limited to that angle until the sides 9*a* and 9*b* of a side frame are in side contact with the corresponding sides 9*a* and 9*b*** of the adjoining side frame. A further inward inclination is prevented due to the presence of such a side contact. Once such a side contact is achieved, the column becomes inherently stable. Alternatively, the module may be withdrawn upwardly, and in the first instance, until such a side contact is established. Thus, once a complete erection position of a module is established, a compression force or load acting on the module prevents a collapse of the module. Accordingly, larger the force or load applied to the module in the downward direction, the greater is the locking action and whereby a collapse of said module in the inward or outward direction is prevented.

Such a compression load is provided to the second uppermost module and the modules subsequent thereto due to the weight of the preceding modules and, thereby, providing for the stability and locking properties. Thus, a self locking action of the side plates, except for that of the uppermost module, is ensured by the load provided by the weight of the preceding modules and such that the greater the load, the better is the interlocking action. Still further, and referring to the uppermost module, the weight of the upper member acting on the lower member provides a satisfactory interlocking action. However, any suitable interlocking means for the side plates may, if required, be used for the uppermost module. Still further, and only as a precaution, and if required, interlocking means for the side plates of the subsequent modules may also be used. It will be apparent that a collapse of a module, or that of the column, is prevented due to the fact that firstly the side plates of both the first and second members are inclined inwardly and thus a presence of a load along the vertical axis and in the downward direction prevents the possibility of the side plates from being displaced outwardly. In fact, presence of such a load would urge the side plates in the inward direction. However, once the side plates establish a side contact with the adjacent side plates, a displacement in the inward direction is prevented.

It will be apparent that the column having the modules of this invention can be erected from the surface by only withdrawing the uppermost followed by each subsequent module to their erect position. Similarly the erect column can be collapsed by applying an outward force to the side plates of the lowermost module, followed by each preceeding module, and such that the modules are converted into a collapsed status.

Further, in accordance with this invention, the center of the hinge at the proximal side 8 coincides with the center of the hinge at the distal side 6 of the same side frame 7. Still further, the center of the proximal side 8 of a side frame 7 of one member coincides with the center of the proximal side of the side frame of the other member to which it is hinged to constitute a module. Further, and when the module is in in erect position, the two centers of the proximal and distal sides 8 and 6 respectively of any two side frames hinged to each other lies along the same vertical plane but wherein the centres of the proximal sides and distal sides lie along different vertical lines.

Still further in accordance with this invention, the line passing through the centre of the proximal and distal sides of each side frame of each member coincides with the centre of the base of that member, when the module is in a collapsed position.

I claim:

1. A collapsible module comprising an upper and lower member provided in an opposite relationship to each other, each of said members comprising an equilateral polygon base plate or frame, a plurality of side frames or plates, of the same number as the number of sides of said polygon hingedly connected at their proximal end to said base plate or frame, the distal end of said side frames being hingedly connected to the distal end of the side frames or plates of the other member, wherein the sides of said side frames taper inwardly from said base plate or frame to give a trapezoidal configuration to each of said side frame or plates, the center of the hinge of the proximal side coinciding with the center of the hinge at the distal side of the same side plate or frame and the center of the proximal side of a side plate of one member coinciding with the center of the proximal side of the side plate of the other member to which it is hinged, such that in an erect position the side plates of each member are disposed inwardly to the vertical axis of said module and the two sides of one side plate of any one member is in side contact with the adjoining side plates of the same member, and such that in the collapsed position said side plates or frames lie outwardly of their respective base plate or frame.

2. A collapsible module as claimed in claim 1 wherein and when the module is in an erect position, the centers of the proximal and distal sides of any two side plates hinged to each other lies along the same vertical plane, but wherein the centers of the proximal sides and distal sides lie along different vertical lines.

3. A collapsible module as claimed in claim 1 wherein the line passing through the center of the proximal and distal sides of each side plate of each member coincides with the center of the base plate or frame of that member, when the module is in a collapsed position.

4. A collapsible column comprising a plurality of said collapsible modules of claim 1 wherein the base plate or frame of one of said collapsible module coincides with the base plate or frame of the adjacent collapsible module.

5. A collapsible column as claimed in claim 4 wherein the base frame of the upper member of one module forms the base frame of the lower member of the adjacent module.

6. A collapsible module comprising an upper and lower member provided in an opposite relationship to each other, each of said members comprising a base plate or frame, a plurality of side frames or plates hingedly connected at their proximal end to said base plate or frame, the distal end of said side frames or plates of the lower member being hingedly connected to the distal end of the side frames or plates of the upper member, wherein the sides of said side frames or plates taper inwardly from said base plate or frame and wherein the two sides of one side plate or frame of any one member is in complete or partial side contact with the adjoining side plates or frames of the same member, when the module is in an erect position, and further such that in said erect and locked position the side plates or frames of each member are disposed inwardly to the vertical axis of said module and in the collapsed position the side plates or frames lie outwardly of their respective base plate or frame.

7. A collapsible module as claimed in claim 6 wherein the center of the hinge at the proximal end coincides with the center of the hinge at the distal end of the same side plate or frame.

8. A collapsible module as claimed in claim 7 wherein the line passing through the center of the proximal and distal ends of each side plate of each member coincides with the center of the base plate or frame of that member, when the module is in a collapsed position.

9. A collapsible column as claimed in claim 8 wherein the base frame of the upper member of one module forms the base frame of the lower member of the adjacent module.

10. A collapsible module as claimed in claim 6 wherein the center of the proximal end of a side plate or frame of one member coincides with the center of the proximal end of the side plate or frame of the other member to which it is hinged to constitute a module.

11. A collapsible module as claimed in claim 6 wherein and when the module is in an erect position, the centers of the proximal and distal end of any two side plates hinged to each other lies along the same vertical plane, but wherein the centers of the proximal end and distal end lie along different vertical lines.

12. A collapsible frame comprising a plurality of collapsible modules and wherein adjacent modules are hingedly connected to each other, each of said collapsible modules comprising a lower member and an upper member being provided in an opposite relationship to each other, each of said members comprising a base plate or frame, a plurality of side frames or plates hingedly connected at their proximal end to said base plate or frame, the distal end of said side frames or plates of the lower member being hingedly connected to the distal end of the side frames or plates of the upper member, wherein the sides of said side frames or plates taper inwardly from said base plate or frame and wherein the two sides of one side plate or frame of any one member is in complete or partial side contact with the adjoining side plates or frames of the same member, when the module is in an erect position, and further such that in said erect and locked position the side plates or frames, or each member are disposed inwardly to the vertical axis of said module and in the collapsed position the side plates or frames lie outwardly of their respective base plate or frame.

* * * * *